US006270204B1

(12) United States Patent
Barrett et al.

(10) Patent No.: US 6,270,204 B1
(45) Date of Patent: Aug. 7, 2001

(54) INK PEN ASSEMBLY

(75) Inventors: Douglas J. Barrett; Matthew Dolan, both of Westford; Carlos A. Gomez, Framingham; Thomas Hagerty, Somerville, all of MA (US)

(73) Assignee: Iris Graphics, Inc., Billerica, MA (US)

( * ) Notice: Subject to any disclaimer, the term of this patent is extended or adjusted under 35 U.S.C. 154(b) by 0 days.

(21) Appl. No.: 09/042,031

(22) Filed: Mar. 13, 1998

(51) Int. Cl.[7] ..... B41J 2/07

(52) U.S. Cl. ..... 347/74

(58) Field of Search ..... 347/74, 75, 76, 347/78, 84, 49, 50

(56) References Cited

U.S. PATENT DOCUMENTS

| | | | | |
|---|---|---|---|---|
| Re. 34,932 | | 5/1995 | Gray | 347/74 |
| 3,798,656 | | 3/1974 | Lowy et al. | 346/1 |
| 3,813,675 | | 5/1974 | Steffy et al. | 346/75 |
| 4,035,811 | | 7/1977 | Paranjpe | 346/75 |
| 4,246,589 | | 1/1981 | Denny et al. | 346/75 |
| 4,268,836 | | 5/1981 | Huliba et al. | 346/75 |
| 4,321,608 | | 3/1982 | Kakeno | 346/75 |
| 4,376,284 | | 3/1983 | Bader et al. | 346/140 |
| 4,442,440 | | 4/1984 | Elchinger | 346/1.1 |
| 4,540,990 | | 9/1985 | Crean | 346/75 |
| 4,604,630 | | 8/1986 | Thell | 346/1.1 |
| 4,614,953 | | 9/1986 | Lapeyre | 346/140 |
| 4,620,198 | | 10/1986 | Behum | 346/75 |
| 4,628,331 | | 12/1986 | Ishikawa | 346/75 |
| 4,636,808 | | 1/1987 | Herron | 346/75 |
| 4,638,328 | | 1/1987 | Drake et al. | 346/75 |
| 4,639,736 | * | 1/1987 | Jochimsen et al. | 347/74 |
| 4,668,959 | | 5/1987 | Jochimsen et al. | 346/1.1 |
| 4,672,390 | | 6/1987 | Ishikawa | 346/75 |
| 4,734,711 | | 3/1988 | Piatt et al. | 346/75 |
| 4,809,015 | * | 2/1989 | Bowling et al. | 347/74 |
| 4,811,035 | | 3/1989 | Huliba et al. | 346/75 |
| 4,814,788 | | 3/1989 | Davies | 346/75 |
| 4,879,565 | | 11/1989 | Fujii | 346/75 |
| 4,897,667 | | 1/1990 | Uchiyama et al. | 346/78 |
| 4,928,113 | | 5/1990 | Howell et al. | 346/75 |
| 4,928,114 | | 5/1990 | Fagerquist et al. | 346/75 |
| 4,928,115 | | 5/1990 | Fagerquist et al. | 346/75 |
| 4,929,966 | | 5/1990 | Sexton et al. | 346/75 |
| 4,937,589 | | 6/1990 | Fagerquist et al. | 346/75 |
| 4,999,644 | | 3/1991 | Katerberg et al. | 346/1.1 |
| 4,999,647 | | 3/1991 | Wood et al. | 346/75 |
| 5,087,924 | | 2/1992 | Zaba et al. | 346/75 |
| 5,105,205 | | 4/1992 | Fagerquist | 346/75 |
| 5,160,938 | | 11/1992 | Fargo et al. | 346/1.1 |
| 5,227,813 | | 7/1993 | Pies et al. | 346/140 |

(List continued on next page.)

FOREIGN PATENT DOCUMENTS

| | | |
|---|---|---|
| 0 721 844 | 7/1996 | (EP) . |
| 0741040 | 11/1996 | (EP) . |
| 0 780 231 | 6/1997 | (EP) . |
| WO 86 02959 | 5/1986 | (WO) . |

*Primary Examiner*—Huan Tran
*Assistant Examiner*—Michael Nghiem
(74) *Attorney, Agent, or Firm*—Fish & Richardson, P.C.

(57) ABSTRACT

An ink pen assembly of a continuous ink jet printer includes a printhead nest and an ink pen cartridge removably received within the nest. The cartridge includes a pen body in electrical communication with the printhead nest, and a nozzle body in fluid communication with the printhead nest. A charge electrode charges ink drops breaking off from ink jetted from an outlet of the nozzle body. A deflection electrode deflects the charged ink drops along an axis substantially transverse to a direction of travel of a substrate being printed. An ink block mount includes an ink blocking element for diverting deflected ink drops. An ink block actuator pivots with respect to the pen body to adjust the position of the ink blocking element. The printhead nest defines at least four ink outlets for delivering different colored inks, and at least four ink pen cartridges are removably received by the printhead nest.

29 Claims, 8 Drawing Sheets

U.S. PATENT DOCUMENTS

| | | | | |
|---|---|---|---|---|
| 5,325,112 | | 6/1994 | Muto | 347/19 |
| 5,337,071 | | 8/1994 | East et al. | 347/77 |
| 5,402,164 | | 3/1995 | Mutoh | 347/81 |
| 5,407,136 | * | 4/1995 | West et al. | 347/74 |
| 5,410,342 | | 4/1995 | Lecheheb et al. | 347/77 |
| 5,416,612 | | 5/1995 | Ingraham et al. | 358/501 |
| 5,428,375 | | 6/1995 | Simon et al. | 347/12 |
| 5,450,111 | | 9/1995 | Mutoh | 347/78 |
| 5,455,614 | | 10/1995 | Rhodes | 347/74 |
| 5,469,201 | | 11/1995 | Erickson et al. | 347/85 |
| 5,475,409 | | 12/1995 | Simon et al. | 347/74 |
| 5,477,254 | | 12/1995 | Stephens | 347/74 |
| 5,489,929 | | 2/1996 | Vago | 347/55 |
| 5,491,499 | | 2/1996 | Bibbe et al. | 347/47 |
| 5,502,473 | | 3/1996 | East et al. | 347/73 |
| 5,583,551 | | 12/1996 | Allred et al. | 347/77 |
| 5,598,197 | | 1/1997 | Zaba | 347/75 |
| 5,625,397 | | 4/1997 | Allred et al. | 347/100 |
| 5,675,367 | * | 10/1997 | Scheffelin et al. | 347/86 |
| 5,682,191 | * | 10/1997 | Barrett et al. | 347/73 |
| 5,808,642 | * | 9/1998 | Zaba et al. | 347/74 |

* cited by examiner

INK PEN ASSEMBLY

BACKGROUND OF THE INVENTION

The invention relates to an ink pen assembly of a continuous ink jet printer.

As described in Jochimsen, U.S. Pat. No. 4,639,736, titled INK JET RECORDER, incorporated by reference herein, continuous ink jet printers produce a continuous stream of ink drops directed at a substrate. The ink drops include printing and non-printing drops. The ink drops are selectively charged such that the non-printing drops are deflected to prevent the non-printing drops from reaching the substrate.

A removable nozzle unit including a charging tunnel for producing a continuous stream of ink drops and charging the non-printing drops is described in Fargo et al., U.S. Pat. No. 5,160,938, titled METHOD AND MEANS FOR CALIBRATING AN INK JET PRINTER, incorporated by reference herein.

SUMMARY OF THE INVENTION

According to one aspect of the invention, an ink pen cartridge is removably received within a printhead nest of a continuous ink jet printer. The ink pen cartridge includes a pen body configured to be placed in electrical communication with the printhead nest, and a nozzle body which defines an inlet configured to be placed in fluid communication with the printhead nest to receive ink from the printhead nest. The nozzle body also has an outlet through which ink is jetted.

A charge electrode charges ink drops breaking off from the ink jetted from the nozzle body outlet. A deflection electrode deflects the charged ink drops. The deflection electrode is configured and arranged such that charged ink drops are deflected along an axis substantially transverse to a direction of travel of a substrate to be printed.

Embodiments of this aspect of the invention may includes one or more of the following features.

An ink block mount is connected to the pen body and includes an ink blocking element for diverting deflected ink drops. An ink block actuator configured to be placed in mechanical communication with the printhead nest is used to adjust the position of the ink blocking element. The ink block actuator is mounted to the pen body to pivot with respect to the pen body.

The nozzle body houses a tube through which ink flows. A transducer is mounted to the tube for synchronizing breakup of ink jetted from the nozzle body outlet into ink drops.

The pen body defines an ink drain for draining ink from the pen body to the printhead nest. A mist bib formed from, e.g, acid-etched stainless steel, is mounted to the pen body for collecting spray produced when ink droplets contact a substrate.

An electrical connection board is mounted to the pen body for providing the electrical communication with the printhead nest.

In certain embodiments, the pen body includes a barrier plate defining a drop charging chamber. The charge tunnel and deflection electrodes are located within the drop charging chamber and spaced from the barrier plate. The barrier plate is inclined with respect to a side wall of the drop charging chamber.

According to another aspect of the invention, an ink pen cartridge removably received within a printhead nest of a continuous ink jet printer includes a pen body, a nozzle body, a deflection electrode, and an ink block actuator configured to be placed in mechanical communication with the printhead nest. Movement of the ink block actuator relative to the pen body adjusts the position of an ink blocking element.

Embodiments of this aspect of the invention may includes one or more of the following features.

A charge electrode charges ink drops breaking off from the ink jetted from the nozzle body outlet. An ink block mount includes the ink blocking element for diverting the deflected ink drops.

According to another aspect of the invention, an ink jet nozzle includes a nozzle body defining an ink passage and a vacuum passage. A jet housing is located within the ink passage. A tube is located within a through bore of the jet housing. An outlet of the vacuum passage is in fluid communication with an outlet end of the tube. An ink passage inlet and a vacuum passage inlet are defined in a single sealing face of the nozzle body.

Embodiments of this aspect of the invention may includes one or more of the following features.

An ink passage seal is located at the inlet of the ink passage, and a vacuum passage seal is located at the inlet of the vacuum passage.

A transducer is mounted to the tube for synchronizing breakup of a jet of ink from the tube outlet into ink drops. A first spring abuts the transducer on an upstream side of the transducer, and a second spring abuts the transducer on a downstream side of the transducer. The first and second springs locate the transducer with respect to the tube prior to fixing the transducer to the tube. The second spring is connected to a ground plane of the transducer to act as a shield.

The tube comprises a capillary tube having an inner diameter of about 100 microns. The inner diameter is reduced to about 10 microns at the outlet end of the tube. A filter is located at the inlet end of the tube.

According to another aspect of the invention, a printhead nest for receiving an ink pen cartridge includes a housing defining an ink outlet for providing ink to the ink pen cartridge, a mechanical link for interfacing with the ink pen cartridge to adjust the position of an ink blocking element of the ink pen cartridge, and an electrical connection for interfacing with the ink pen cartridge to control a deflection electrode of the ink pen cartridge.

Embodiments of this aspect of the invention may includes one or more of the following features.

A fluid catcher receives ink that drains from the ink pen cartridge. The housing defines four ink outlets, four mechanical links, and four electrical connections. The ink outlets provide ink to four ink pen cartridge. The mechanical links and electrical connections each interface with one of the four ink pen cartridges.

According to another aspect of the invention, an ink pen assembly includes an ink pen cartridge and a printhead nest. The ink pen cartridge includes a pen body, a nozzle body, a charge electrode, and a deflection electrode. The printhead nest includes a housing defining an ink outlet for providing ink to an inlet of the nozzle body, and an electrical connection for interfacing with the pen body to control the charge tunnel and deflection electrodes. The ink pen is configured for placement in the printhead nest and removal from the printhead nest as a single unit.

According to another aspect of the invention a continuous ink jet printer includes a printhead nest defining at least four ink outlets. The printhead nest is configured to deliver a different colored ink through each of four ink outlets. At least four ink pen cartridges are removably received by the printhead nest. Each ink pen cartridge defines an ink inlet aligned with one of the ink outlets for receiving ink from the printhead nest when the ink pen cartridges are received by the printhead nest. Each ink pen cartridge also includes a charge electrode for charging ink drops breaking off from the received ink, and a deflection electrode for deflecting charged ink drops. Each deflection electrode is configured and arranged such that charged ink drops are deflected along an axis substantially transverse to a direction of travel of a substrate to be printed. The charge electrode is adjustable to impart varying levels of charge to the ink drops such that different ink drops are deflected by different amounts by the deflection electrode to facilitate registration of the ink drops from the at least four ink pen cartridges on a substrate.

Advantages of the invention includes a disposable ink pen cartridge which includes all of the components of a continuous ink jet printhead, e.g., the drop producing, drop charging, and drop deflecting elements, which are likely to fail. The ink pen cartridge can be quickly removed and disposed of and replaced with a new cartridge. The failed cartridge can be replaced even while the continuous ink jet printer remains turned on.

Other features and advantages of the invention will be apparent from the following detailed description, and from the claims.

DESCRIPTION OF THE PREFERRED EMBODIMENT

Figure 1:
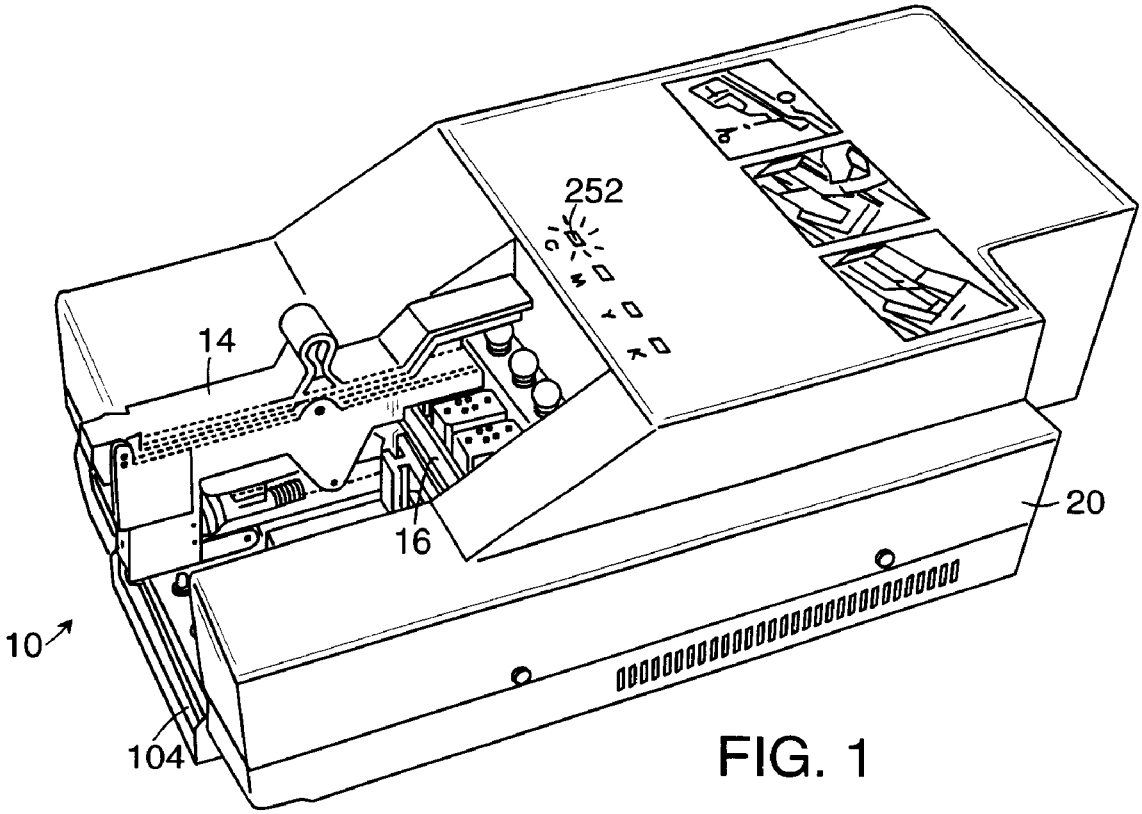
FIG. 1 is a schematic illustration of an ink pen assembly of the invention.

Referring to FIG. 1, an ink pen assembly 10 of a continuous ink jet printer includes a printhead nest 16 and up to four disposable ink pen cartridges 14, one cartridge being shown in FIG. 1, received by nest 16. Nest 16 is a component of a pen electronics board assembly 20 mounted to move along a lead screw 22 (FIGS. 6B and 7) of the printer. Each ink pen preferably deliveries a different color ink to a substrate to produce a multi-color image on the substrate, as described, e.g., in Ingraham et al., U.S. Pat. No. 5,416,612, incorporated by reference herein. When an ink pen becomes clogged or otherwise reaches the end of its useful service life, the ink pen can be removed from the nest and replaced with a new ink pen.

Figure 2:
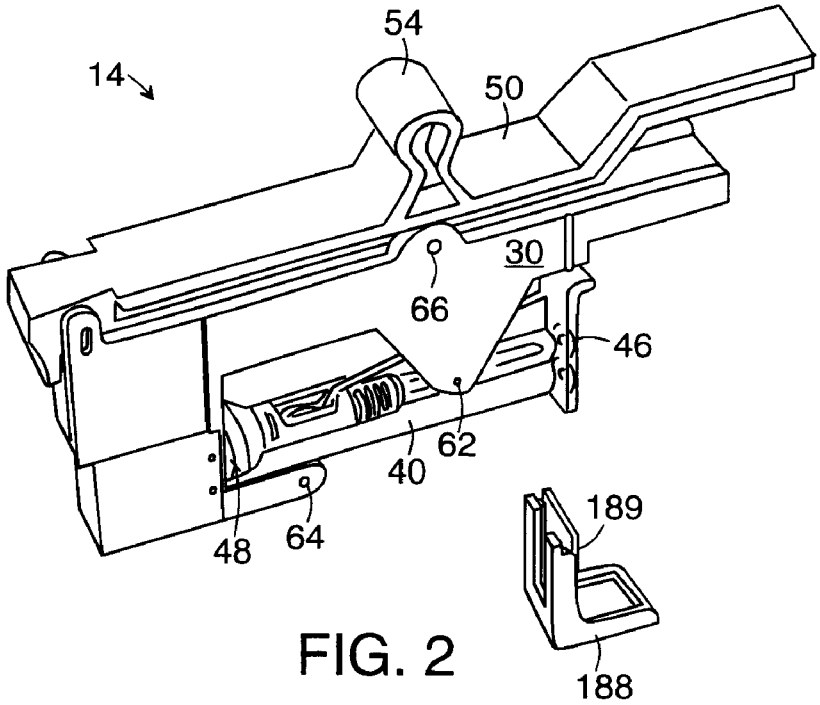
FIG. 2 is a perspective view of an ink pen cartridge of the assembly of FIG. 1.
Figure 3A:
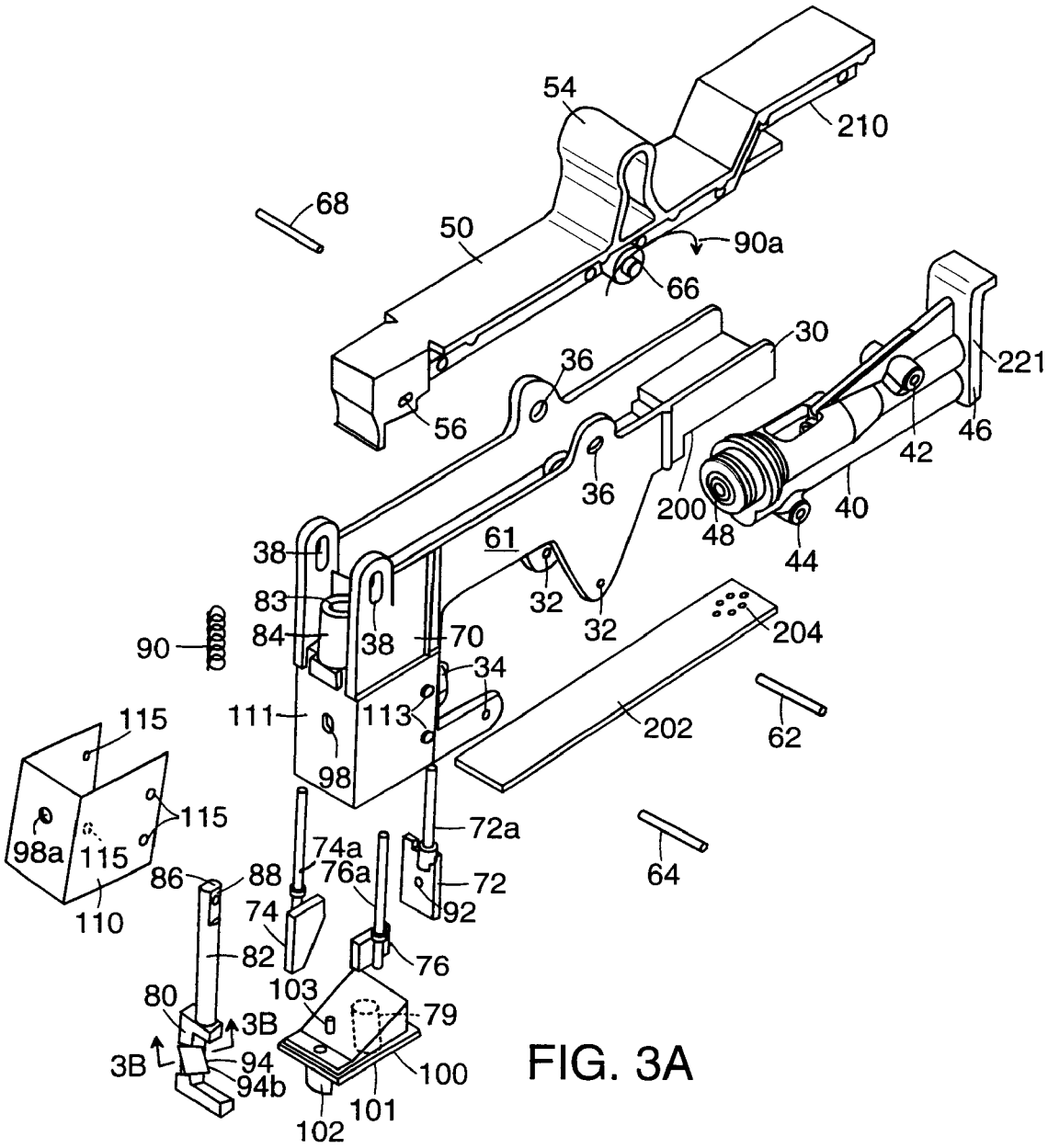
FIG. 3A is an exploded view of the ink pen cartridge of FIG. 2.

Referring to FIGS. 2 and 3A, ink pen cartridge 14 includes a pen body 30 and a nozzle body 40. Nozzle body 40 is mounted to pen body 30 with pins 62, 64 which pass through mounting holes 32, 34 in pen body 30 and corresponding mounting holes 42, 44 in nozzle body 40. An ink block actuator, e.g., knife edge arm 50, is mounted to pen body 30 to pivot about a pivot pin 66 received in mounting holes 36 of pen body 30. A finger grip 54 of arm 50 provides an easy means for the user to grasp ink pen 14 for insertion and removal from nest 16.

Figure 4A:
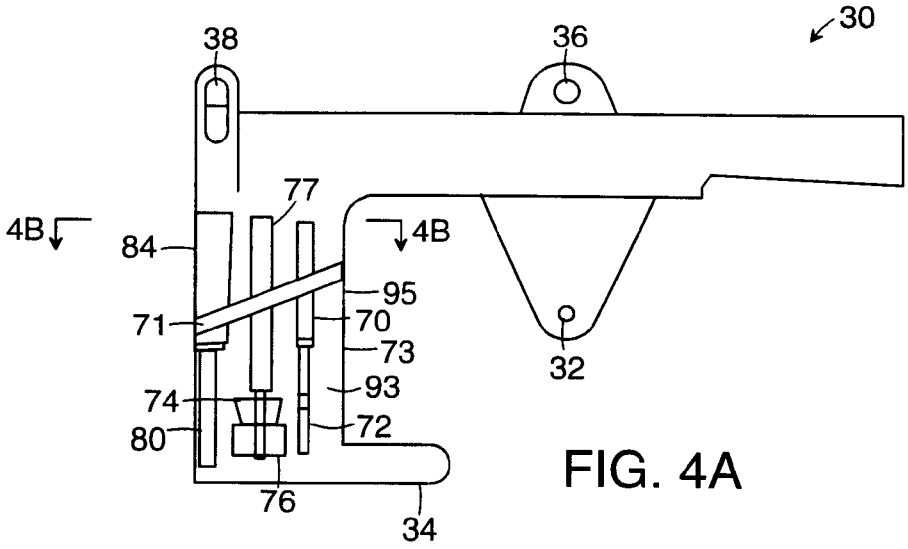
FIG. 4A shows a pen body of the ink pen cartridge of FIG. 2 with a side of the pen body removed.
Figure 4B:
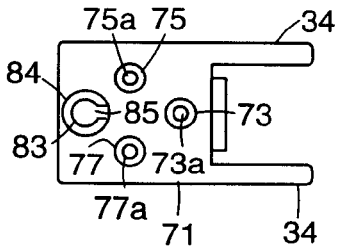
FIG. 4B is a partial bottom view of the pen body of FIG. 4A.

Referring to FIGS. 3A, 4A and 4B, housed within an electrode mounting section 70 of pen body 30 is a charge tunnel 72, a ground deflection electrode 74, a high voltage deflection electrode 76, and an ink blocking element, e.g., knife edge 94. A barrier plate 71 defines a drop charging chamber 93 in which the charge tunnel, electrodes, and knife edge are located. Extending from either side of barrier plate 71 are a knife edge mount 84, a charge tunnel mount 73, a ground electrode mount 75, and a deflection electrode mount 77. Each of the mounts 84, 73, 75, 77 defines a through bore 83, 73*a*, 75*a*, 77*a*, respectively.

A knife edge housing 80 includes a shaft 82 which extends through bore 83 of knife edge mount 84. Bore 83 has a slot 85 which permits flow of air into charging chamber 93. When positioned within mount 84, end 86 of shaft 82 is received within arm 50 such that a hole 88 in shaft 82 is aligned with a pair of holes 56 (only one hole is shown in FIG. 3A) in arm 50. When assembled, holes 56 and 88 are aligned with a pair of slots 38 in pen body 30. A pin 68 passes through slots 38 and holes 56 and 88 such that movement of arm 50 about its pivot point causes pin 68 to slide vertically within slots 38 thus changing the vertical position of knife edge 94. A spring 90 captured between guide 84 and arm 50 biases arm 50 to pivot about pivot pin 66 in the direction of arrow 90*a*.

Shafts 72*a*, 74*a*, 76*a* of the charge tunnel, ground electrode, and deflection electrode, respectively, are mounted within through bores 73*a*, 75*a*, 77*a*, respectively. The charge tunnel, electrodes and knife edge are spaced from barrier plate 71, e.g., by about ⅜ inch, and barrier plate 71 is inclined, e.g., by about 45 degrees, with respect to a side wall 95 of drop charging chamber 93. This spacing tends to limit spray of ink onto barrier plate 71, and the inclined position of the barrier plate facilitates dripping of any ink that does reach the barrier plate off of the barrier plate.

Referring again to FIG. 3A, in use, printing ink is received at a first end 46 of nozzle body 40 and is delivered as discrete ink droplets from a second end 48 of the nozzle body. Non-printing ink drops exiting from nozzle body 40 are charged when passing through a hole 92 in charge tunnel 72. The charged non-printing ink drops are deflected by electrodes 74, 76 in a direction transverse to a direction of travel of the substrate (see arrow A, FIG. 6B) such that the non-printing drops impact knife edge 94 preventing the non-printing ink drops from reaching the substrate.

Figure 3B:
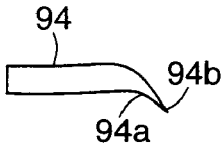
FIG. 3B is a side view of a knife edge of the ink pen cartridge of FIG. 2.

Referring to FIG. 3B, knife edge 94 has a curved ink contacting surface 94*a* along an edge 94*b*. The knife edge is preferably formed from, e.g., zirconia ceramic, that is injected molded and then ground on one side to produce a sharp edge. Non-printing ink drops hit surface 94*a* and roll down the knife edge. A bottom cap 100 (FIGS. 3A and 4A) mounted to pen body 30 includes a drain port 102 through which non-printing ink drops falling from knife edge 94 pass to a collection tray 104 of nest 16 (FIG. 1). Bottom cap 100 also defines a drip-inducing post 103 positioned below ground electrode 74 to induce any ink which may fall on electrode 74 to drip off of electrode 74. A nest mounting guide 79 extends from a bottom surface 101 of cap 100.

Printing ink drops passing through charge tunnel 72 are charged to a lesser degree than the non-printing ink drops such that the printing ink drops are not deflected by the electrodes into the knife edge. The printing ink drops pass by the knife edge and through an outlet 98 to contact the substrate.

A mist bib 110 is positioned over lower section 111 of mounting section 70. Lower section 111 includes four protrusions 113 (two protrusions are shown in FIG. 3A) over which holes 115 in mist bib 110 are positioned to mount mist bib 110 to lower section 111. Mist bib 110 defines an outlet 98*a* through which the printing ink drops pass to contact the substrate. Mist bib 110 acts to collect spray formed when the ink drops contact the substrate. Mist bib 110 is formed, e.g., by photo-mask engraving stainless steel having a photoresist coating, and acid-etching the exposed areas of the stainless steel.

Figure 5A:
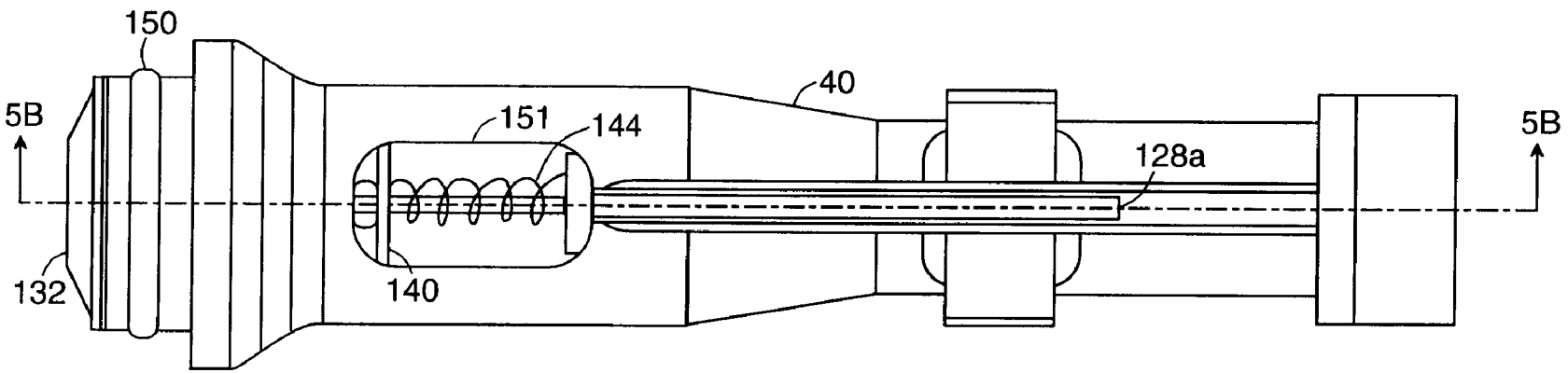
FIG. 5A is a top view of a nozzle body of the ink pen cartridge of FIG. 2.
Figure 5B:
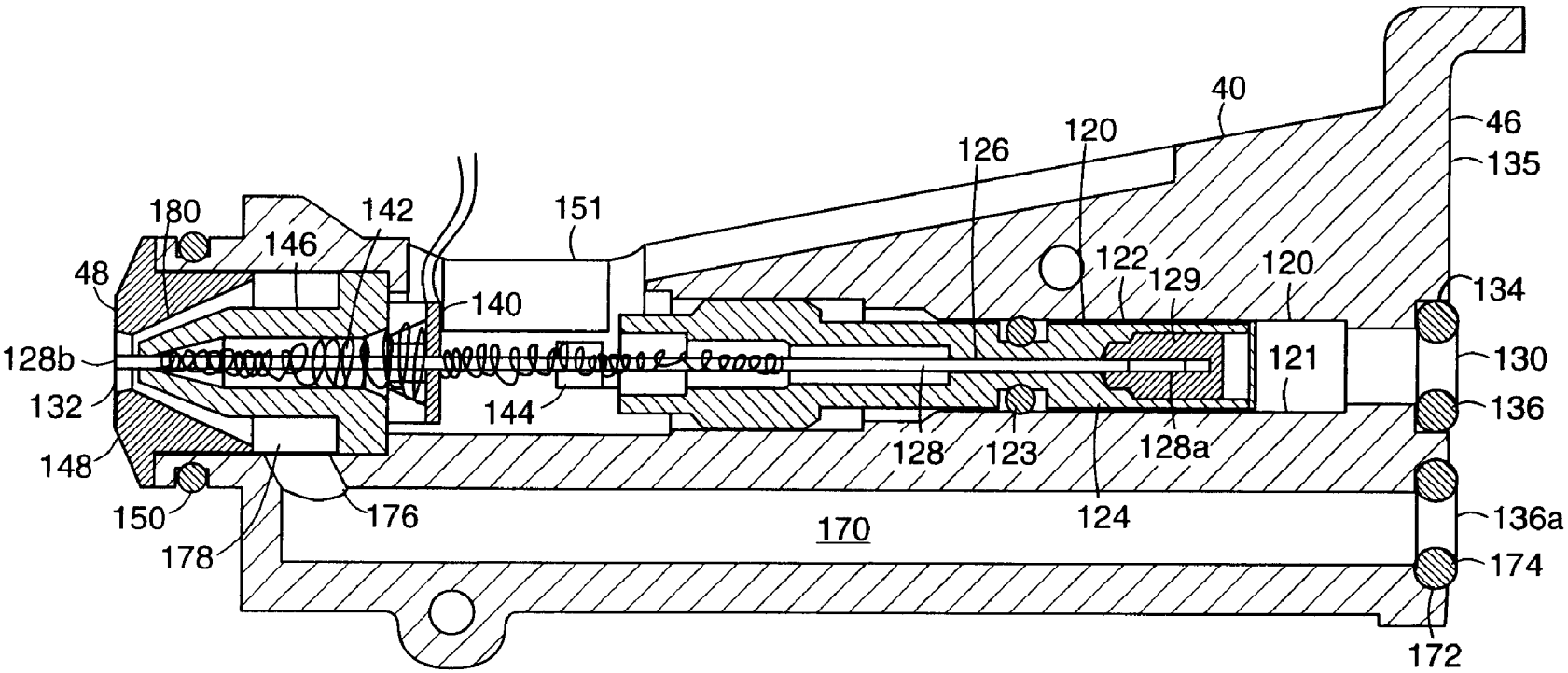
FIG. 5B is a cross-sectional side view of the nozzle body of FIG. 5A.

Referring to FIGS. 5A and 5B, the ink jet nozzle body 40 defines an ink passage 120 having an inlet 130 and an outlet 132. An o-ring cavity 134 located at inlet 130 in a face 135 of nozzle body 40 houses an o-ring 136. O-ring 136 provides a seal with nest 16, described further below. A jet housing 122 is received in passage 120 with an o-ring 123 providing a seal between jet housing 122 and a wall 121 of passage 120.

Jet housing 122 includes a body 124 defining a channel 126. A capillary tube 128, e.g., a 100 micron inner diameter tube, located within channel 126 has an inlet end 128*a* and an outlet end 128*b* extending to outlet 132. Tube 128 has a 10 micron restriction at outlet end 128*b*. A piezoelectric transducer 140 is received over capillary tube 128. The restriction in tube 128 and transducer 140 cause ink flowing through tube 128 to be broken into discrete ink drops, as described in West et al., U.S. Pat. No. 5,407,136, titled INK-JET NOZZLE, incorporated by reference herein. Transducer 140 acts to synchronize the breakup of the ink into drops. Ink flowing in inlet 130 passes through filter 129 before entering tube 128. Filter 129 is glued in place, e.g., by a preformed epoxy ring which melts at a given temperature.

A pair of springs 142, 144 are positioned over tube 128 on either side of transducer 140. The springs locate transducer 140 with respect to tube 128 prior to fixing the transducer to the tube. Spring 142 is connected to a ground plane of the transducer to act as a shield.

A nozzle 146 supports tube 128. An end cap 148 provides a seal around tube 128 at outlet end 132 of ink passage 120. An o-ring 150 provides a seal between pen body 30 and nozzle body 40. To secure transducer 140 to tube 128, solid potting is applied through an opening 151 in nozzle body 40.

Nozzle body 40 also defines a vacuum passage 170. A second o-ring cavity 172 located at a vacuum inlet 130*a* in end face 135 of the nozzle body houses an o-ring 174. O-ring 174 provides a seal with nest 16, described further below. An outlet 176 of vacuum passage 170 communicates with the distal end of the tube through region 178 surrounding nozzle 146 and channel 180 defined between end cap 148 and nozzle 146. Cleaning fluid can be pumped into chamber 93 through vacuum passage 170.

An o-ring cover 188 (FIG. 2) is provided to retain o-rings 136, 174 in o-ring cavities 134, 172, respectively, prior to positioning of the ink pen in the printhead nest. o-ring cover 188 includes a t-slot 189 which fits over a nozzle body lip 121.

Beside having ink and vacuum communication with nest 16, ink pen 14 is also in electrical and mechanical connection with nest 16. Referring to FIG. 3A, mounted to an underside 200 of ink pen body 30 is an electrical connection board 202. Board 202 includes electrical contacts 204 which interface with nest 16 to provide signals to transducer 140, charge tunnel 72, and electrodes 74, 76, as described further below.

Figure 6A:
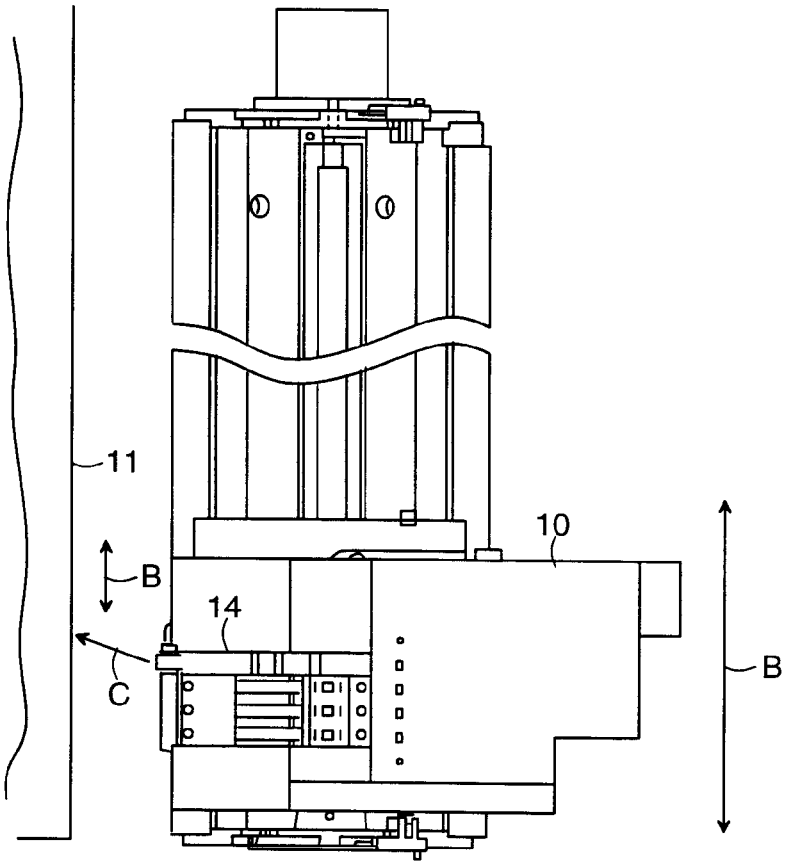
FIG. 6A is a top view of the assembly of FIG. 1 shown during printing on a substrate.
Figure 6B:
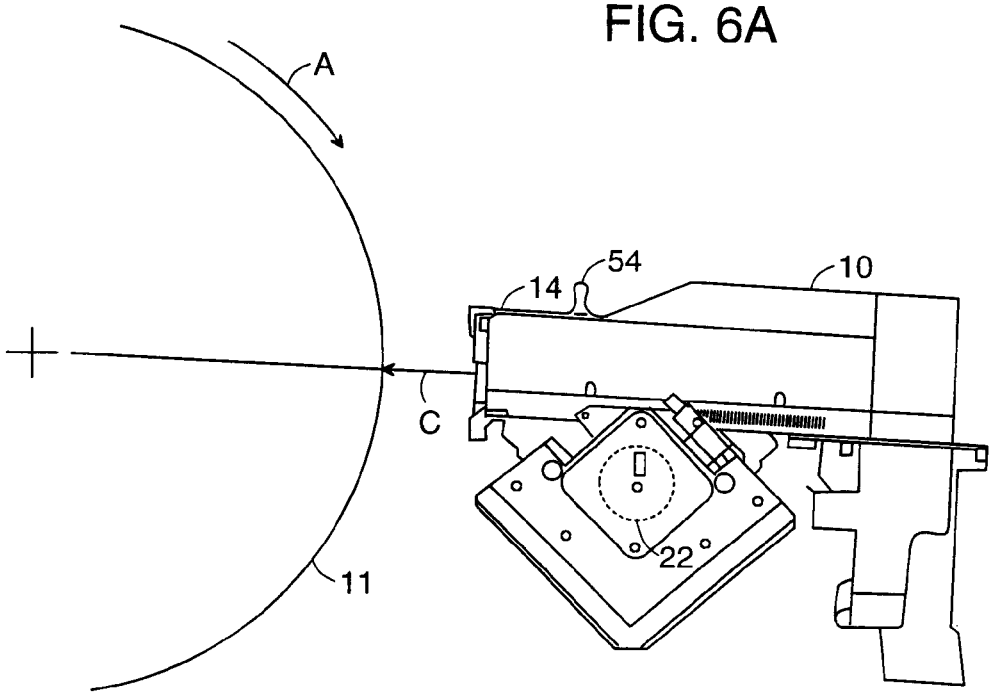
FIG. 6B is a side view of the assembly of FIG. 1 shown during printing on the substrate.

To register ink drops in print processing of color images, as described, e.g., in Ingraham et al., supra, the charge applied to the printing ink drops by the charge tunnel is varied to adjust the deflection of the printing ink drops in a direction transverse to the direction of travel of the substrate. Referring to FIGS. 6A and 6B, electrodes 74, 76 are oriented with respect to the direction of travel of the substrate (along arrow A) such that the electrodes deflect the ink drops along arrow B, oriented in a direction transverse to substrate travel and in the direction of travel of ink pen assembly 10. This results in a trajectory of the ink drop along arrow C. To accommodate changes in the charge of the printing drops, the knife edge is moved by adjusting the position of the knife edge arm, as described below, to insure that non-printing drops hit the knife edge while the printing drops pass by the knife edge.

Registration of four ink colors delivered by the four ink pens is performed by adjusting the charge applied to the printing ink drops by the charge tunnel (by varying the voltage applied to the charge tunnel), and by adjusting the pixel locations in the direction of substrate travel, as described in Ingraham et al., supra.

Figure 7:
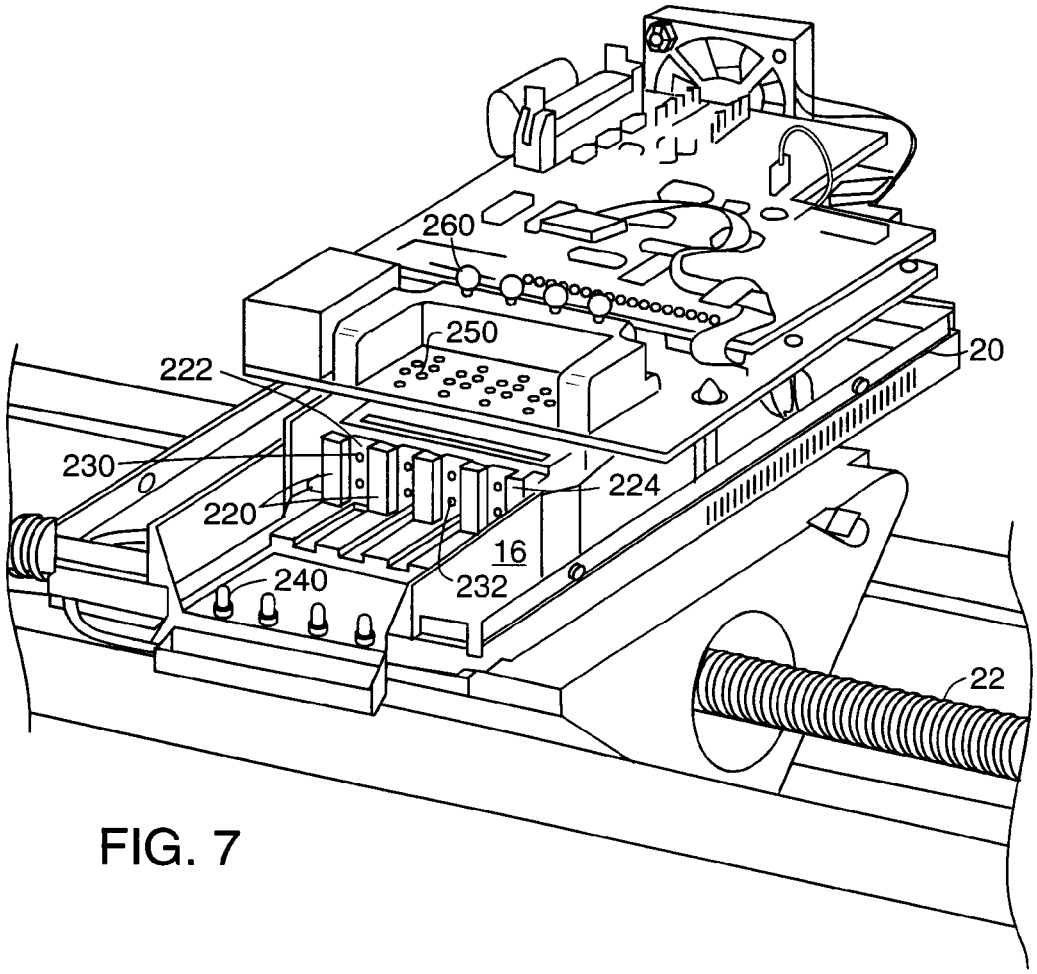
FIG. 7 is an illustration of a pen electronics board assembly of the ink pen assembly of FIG. 1, shown mounted to a continuous ink jet printer.
Figure 8:
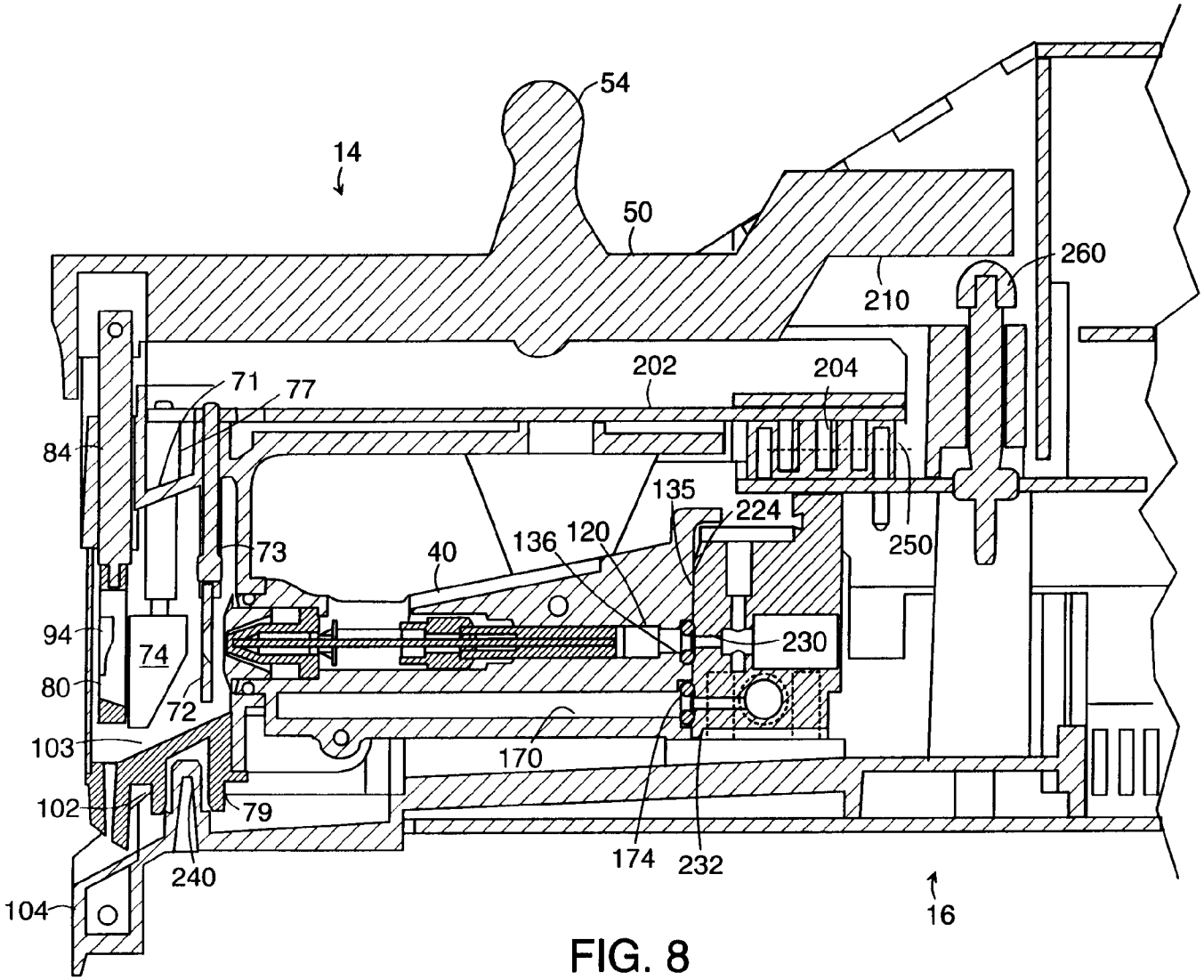
FIG. 8 is a cross-sectional side view showing the interface of the ink pen cartridge of FIG. 2 with a printhead nest of the pen electronics board assembly of FIG. 7.

Referring to FIGS. 7 and 8, nest 16 includes five partitions 220 defining four ink pen receiving t-slots 222. Lip 221 (FIG. 3A) of nozzle body 40 slides into t-slot 222 to connect nozzle body 40 to nest 16. Nest 16 also includes four pins 240. Guide 79 of ink pen cap 100 is received over a respective pin 240 to help align the ink pen with the nest. In a back wall 224 of each slot 222 is an ink outlet 230 and a vacuum outlet 232. With an ink-pen 14 positioned in t-slot 222, ink outlet 230 is in fluid communication with ink passage 120 of nozzle body 40, and vacuum outlet 232 is in fluid communication with vacuum passage 170 of nozzle body 40. O-rings 136, 174 provide seals between wall 224 of nest 16 and end face 135 of nozzle body 40.

To provide an electrical connection between nest 16 and the ink pens, nest 16 includes four electrical contact regions 250. With ink pen 14 positioned in nest 16, contacts 204 of board 202 interface with contact region 250. Each contact region 250 includes six contact points: a 2000 volt power supply; a charge tunnel charge level signal for adjusting the charge imparted to the ink drops by the charge tunnel; a 1 MHz stimulation voltage to the transducer; an ink pen ground; an ink pen sensor; and a primer fixture (described below) sensor. The ink pen sensor and primer fixture sensor sense when an ink pen or the primer fixture are in place in the nest. LEDs 252 (FIG. 1) signal when an ink pen or the primer fixture is in position in the nest.

Nest 16 also includes motor actuated, knife edge positioning pins 260. Each pin 260 contacts an undersurface 210 of arm 50. Raising and lowering of pin 260 causes arm 50 to pivot about its pivot point, thus adjusting the vertical position of knife edge 94.

An ink pen is inserted into nest 16 simply by grasping finger grip 54 and sliding lip 221 of nozzle body 14 into slot 222. When an ink pen needs to be replaced, the individual ink pen is removed from nest 16 simply by pulling up on finger grip 54. The ink pen is hot swapable, i.e., the power to the ink jet printer can be left on when an ink pen is removed from the nest and a new ink pen inserted into the nest. The ink pen sensing contact of the nest detects when the ink pen has been removed and shuts down dangerous voltages until the new ink pen is inserted.

Figure 9:
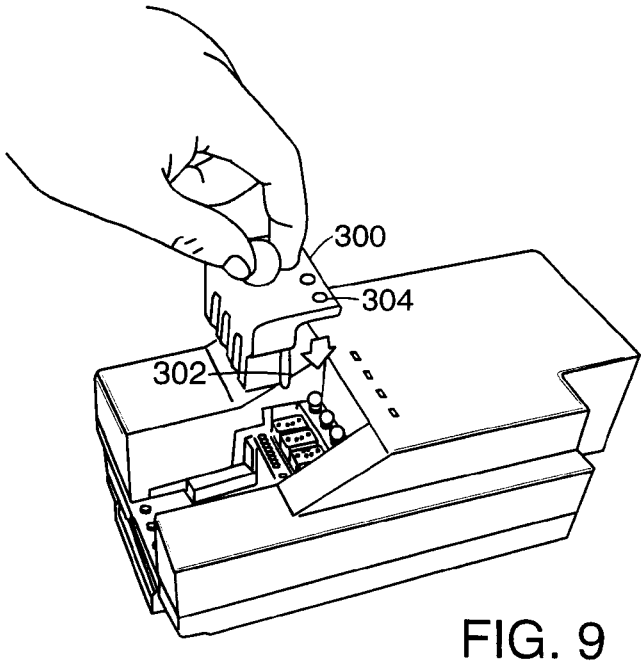
FIG. 9 illustrates a priming pen being mounted to the printhead nest.

Referring to FIG. 9, to prime the system, a priming pen 300 is provided. Pen 300 includes four slots 302 which are received within t-slots 222. Pen 300 includes four electrical contacts 304 which interface with contact region 250 to provide a signal indicating that the priming pen is in position in nest 16.

Other embodiments are within the scope of the following claims.

For example, the nest can be configured to accept more than four ink pens. Eight ink pens would permit color printing twice as fast as with four ink pens, would allow the use of high and low density colors to expand the color range, and would also permit additional colors to be used while printing.

What is claimed is:

1. An ink pen cartridge removably received within a printhead nest of a continuous ink jet printer, comprising:

a pen body configured to be individually placed in electrical communication with the printhead nest such that the ink pen cartridge is individually removable from the printhead nest independently of other ink pen cartridges received within the printhead nest, a nozzle body conected to the pen body, the nozzle body defining an inlet configured to be placed in fluid communication with the printhead nest to receive ink from the printhead nest, the nozzle body further defining, an outlet through which ink is jetted, a charge electrode connected to the pen body for charging ink drops breaking off from the ink jetted from the nozzle body outlet, and a deflection electrode connected to the pen body for deflecting charged ink drops, the deflection electrode being configured and arranged such that charged ink drops are deflected along an axis substantially transverse to a direction of travel of a substrate to be printed.

2. The ink pen cartridge of claim 1 further comprising an ink block mount connected to the pen body, the ink block mount including an ink blocking element for diverting the deflected ink drops.

3. The ink pen cartridge of claim 2 further comprising an ink block actuator connected to the pen body and the ink block mount, the ink block actuator being configured to be placed in mechanical communication with the printhead nest, movement of the ink block actuator relative to the pen body acting to adjust the position of the ink blocking element.

4. The ink pen cartridge of claim 3 wherein the ink block actuator is mounted to the pen body to pivot with respect to the pen body.

5. The ink pen cartridge of claim 1 wherein the nozzle body houses a tube through which ink flows and a transducer mounted to the tube for synchronizing breakup of ink jetted from the nozzle body outlet into ink drops.

6. The ink pen cartridge of claim 1 wherein the pen body defines an ink drain for draining ink from the pen body to the printhead nest.

7. The ink pen cartridge of claim 1 further comprising a mist bib mounted to the pen body for collecting spray produced when ink droplets contact a substrate.

8. The ink pen cartridge of claim 7 wherein the mist bib is formed from acid-etched stainless steel.

9. The ink pen cartridge of claim 1 further comprising an electrical connection board mounted to the pen body for providing the electrical communication with the printhead nest.

10. The ink pen cartridge of claim 1 wherein the pen body includes a barrier plate defining a drop charging chamber, the charge tunnel and deflection electrodes being located within the drop charging chamber and spaced from the barrier plate.

11. The ink pen cartridge of claim 10 wherein the barrier plate is inclined with respect to a side wall of the drop charging chamber.

12. An ink pen cartridge removably received within a printhead nest of a continuous ink jet printer, comprising:

a pen body configured to be individually placed in electrical communication with the printhead nest such that the ink pen cartridge is individually removable from the printhead nest independently of other ink pen cartridges received within the printhead nest, a nozzle body connected to the pen body, the nozzle body defining an inlet configured to be placed in fluid communication with the printhead nest to receive ink from the printhead nest, the nozzle body further defining an outlet through which ink is jetted, a deflection electrode connected to the pen body for deflecting charged ink drops breaking off from the ink jetted from the nozzle body outlet, and an ink block actuator connected to the pen body, the ink block actuator being configured to be placed in mechanical communication with the printhead nest, movement of the ink block actuator relative to the pen body acting to adjust the position of an ink blocking element.

13. The ink pen cartridge of claim 12 further comprising a charge electrode connected to the pen body for charging ink drops breaking off from the ink jetted from the nozzle body outlet.

14. The ink pen cartridge of claim 12 further comprising an ink block mount connected to the pen body and the ink block actuator, the ink block mount including an ink blocking element for diverting the deflected ink drops.

15. An ink jet nozzle, comprising:

a nozzle body defining an ink passage and a vacuum passage, the ink passage having an inlet and an outlet and the vacuum passage having an inlet and an outlet, and a jet housing located within the ink passage, the jet housing defining a through bore, a tube located within the through bore has an inlet end and an outlet end, the vacuum passage outlet being in fluid communication with the tube outlet end, the nozzle body being configured such that the ink passage inlet and the vacuum passage inlet are defined in a single sealing face.

16. The ink jet nozzle of claim 15 further comprising an ink passage seal located at the inlet of the ink passage and a vacuum passage seal located at the inlet of the vacuum passage.

17. The ink jet nozzle of claim 15 further comprising a transducer mounted to the tube for synchronizing breakup of a jet of ink from the tube outlet into ink drops.

18. The ink jet nozzle of claim 17 further comprising a first spring abutting the transducer on an upstream side of the transducer, and a second spring abutting the transducer on a downstream side of the transducer, the first and second springs locating the transducer with respect to the tube prior to fixing the transducer to the tube.

19. The ink jet nozzle of claim 18 wherein the second spring is connected to a ground plane of the transducer to act as a shield.

20. The ink jet nozzle of claim 15 wherein the tube comprises a capillary tube having an inner diameter of about 100 microns, the inner diameter being reduced to about 10 microns at the outlet end of the tube.

21. The ink jet nozzle of claim 15 further comprising a filter located at the inlet end of the tube.

22. A printhead nest for receiving an ink pen cartridge, comprising:

a housing defining an ink outlet for providing ink to the ink pen cartridge, a mechanical link for interfacing with the ink pen cartridge to adjust the position of an ink blocking element of the ink pen cartridge, and an electrical connection for interfacing with the ink pen cartridge to control a deflection electrode of the ink pen cartridge.

23. The printhead nest of claim 22 further comprising a fluid catcher for receiving ink that drains from the ink pen cartridge.

24. The printhead nest of claim 22 further comprising four ink outlets defined by the housing, each ink outlet for providing ink to one of four ink pen cartridge, four mechanical links, each mechanical link for interfacing with one of the four ink pen cartridges, and four electrical connections, each electrical connection for interfacing with one of the four ink pen cartridges.

25. An ink pen assembly, comprising:

an ink pen cartridge and a printhead nest, the ink pen cartridge including a pen body configured to be individually placed in electrical communication with the printhead nest such that the ink pen cartridge is individually removable from the printhead nest independently of other ink pen cartridges received within the printhead nest, a nozzle body connected to the pen body, the nozzle body defining an inlet configured to be placed in fluid communication with the printhead nest to receive ink from the nest structure, the nozzle body further defining an outlet through which ink is jetted, a charge electrode connected to the pen body for charging ink drops breaking off from the ink jetted from the nozzle body outlet, and a deflection electrode connected to the pen body for deflecting charged ink drops, the deflection electrode being configured and arranged such that charged ink drops are deflected along an axis generally transverse to a direction of travel of a substrate to be printed, the printhead nest including a housing defining an ink outlet for providing ink to the nozzle body inlet, and an electrical connection for interfacing with the pen body to control the charge tunnel and deflection electrodes, the ink pen cartridge being configured for placement in the printhead nest and removal from the printhead nest as a single unit.

26. The ink pen assembly of claim 25, comprising a plurality of ink pen cartridges.

27. A continuous ink jet printer, comprising:

a printhead nest defining at least four ink outlets, the printhead nest being configured to deliver a different colored ink through each of four ink, outlets, and at least four ink pen cartridges individually removably received by the printhead nest, each ink pen cartridge defining an ink inlet, each ink inlet being aligned with one of the ink outlets for receiving ink from the printhead nest when the ink pen cartridges are received by the printhead nest, each ink pen cartridge including a charge electrode connected thereto for charging ink drops breaking off from the received ink, and a deflection electrode connected thereto for deflecting charged ink drops, each deflection electrode being configured and arranged such that charged ink drops are deflected along an axis substantially transverse to a direction of travel of a substrate to be printed, the charge electrode being adjustable to impart varying levels of charge to the ink drops such that different ink drops are deflected by different amounts by the deflection electrode to facilitate registration of the ink drops from the at least four ink pen cartridges on a substrate.

28. An ink pen cartridge removably received within a printhead nest of a continuous ink jet printer, comprising:

a pen body configured to be placed in electrical communication with the printhead nest, a nozzle body connected to the pen body, the nozzle body defining an inlet configured to be placed in fluid communication with the printhead nest to receive ink from the printhead nest, the nozzle body further defining an outlet through which ink is jetted, a charge electrode connected to the pen body for charging ink drops breaking off from the ink jetted from the nozzle body outlet, and a deflection electrode connected to the pen body for deflecting charged ink drops, the deflection electrode being configured and arranged such that charged ink drops are deflected along an axis substantially transverse to a direction of travel of a substrate to be printed, wherein the pen body includes a barrier plate defining a drop charging chamber, the charge tunnel and deflection electrodes being located within the drop charging chamber and spaced from the barrier plate.

29. The ink pen cartridge of claim 28, wherein the barrier plate is inclined with respect to a side wall of the drop charging chamber.

* * * * *

UNITED STATES PATENT AND TRADEMARK OFFICE

CERTIFICATE OF CORRECTION

PATENT NO. : 6,270,204 B1
DATED : August 7, 2001
INVENTOR(S) : Douglas J. Barrett, Matthew Dolan, Carlos A. Gomez and Thomas Hagerty It is certified that error appears in the above-identified patent and that said Letters Patent is hereby corrected as shown below:

Column 1,
Line 38, "includes" should be -- include --.

Column 2,
Lines 6, 20 and 47, "includes" should be -- include --.
Line 52, "cartridge" should be -- cartridges --.

Column 6,
Line 9, "o-ring" should be -- O-ring --.

Column 7,
Line 42, after "defining", delete the comma.

Column 9,
Line 35, "cartridge" should be -- cartridges --.

Column 10,
Line 15, after "ink", delete the comma.

Signed and Sealed this

Twenty-sixth Day of March, 2002

*Attest:*

*Attesting Officer*

JAMES E. ROGAN
*Director of the United States Patent and Trademark Office*